United States Patent [19]

Krajewski et al.

[11] Patent Number: 4,737,351

[45] Date of Patent: Apr. 12, 1988

[54] PROCESS FOR THE RECOVERY OF TIN

[75] Inventors: Wolfgang Krajewski, Weissdornweg; Kunibert Hanusch, Schützenallee, both of Fed. Rep. of Germany

[73] Assignee: Preussag Aktiengesellschaft Metall, Goslar, Fed. Rep. of Germany

[21] Appl. No.: 924,180

[22] Filed: Oct. 17, 1986

Related U.S. Application Data

[63] Continuation of Ser. No. 730,777, May 3, 1985, abandoned.

[30] Foreign Application Priority Data

May 23, 1984 [DE] Fed. Rep. of Germany ..... 3419119

[51] Int. Cl.[4] ..... C25F 7/00

[52] U.S. Cl. ..... 423/98; 423/90; 204/121; 75/1 R; 75/101 R; 23/305 R

[58] Field of Search ..... 423/89, 98, 90; 204/121; 23/305 R; 75/1 R, 101 R

[56] References Cited

U.S. PATENT DOCUMENTS

| | | | |
|---|---|---|---|
| 2,329,816 | 9/1943 | Betterton | 423/98 |
| 2,434,283 | 1/1948 | Muskat | 423/98 |
| 2,436,974 | 3/1948 | Richter | 423/98 |
| 3,394,061 | 7/1968 | De Forest et al. | 423/98 |
| 3,767,384 | 10/1973 | Nixon et al. | 423/98 |
| 4,056,450 | 11/1977 | McCauslan et al. | 204/121 |
| 4,225,571 | 9/1980 | de Denus | 423/98 |
| 4,291,009 | 9/1981 | Franks, Jr. | 423/98 |
| 4,352,786 | 10/1982 | Hoh et al. | 423/98 |
| 4,374,098 | 2/1983 | Iid et al. | 423/98 |
| 4,474,655 | 10/1984 | Giezen | 204/121 |

*Primary Examiner*—Helen M. S. Sneed
*Assistant Examiner*—Anthony McFarlane
*Attorney, Agent, or Firm*—Lockwood, Alex, Fitzgibbon & Cummings

[57] ABSTRACT

A process is described for recovering tin from oxide or oxide/sulphide low-grade starting materials and concentrates containing little or relatively low concentrations of tin, in which such low-grade starting materials are mixed with KOH and decomposed at high temperatures. The decomposed substance is then leached with water, and metallic tin is separated out electrolytically in one or more stages from the lye. The electrolyte with reduced tin content is concentrated by evaporation, impurities being removed, and dehydrated. The potassium hydroxide solution recovered is re-used for decomposition.

10 Claims, 1 Drawing Sheet

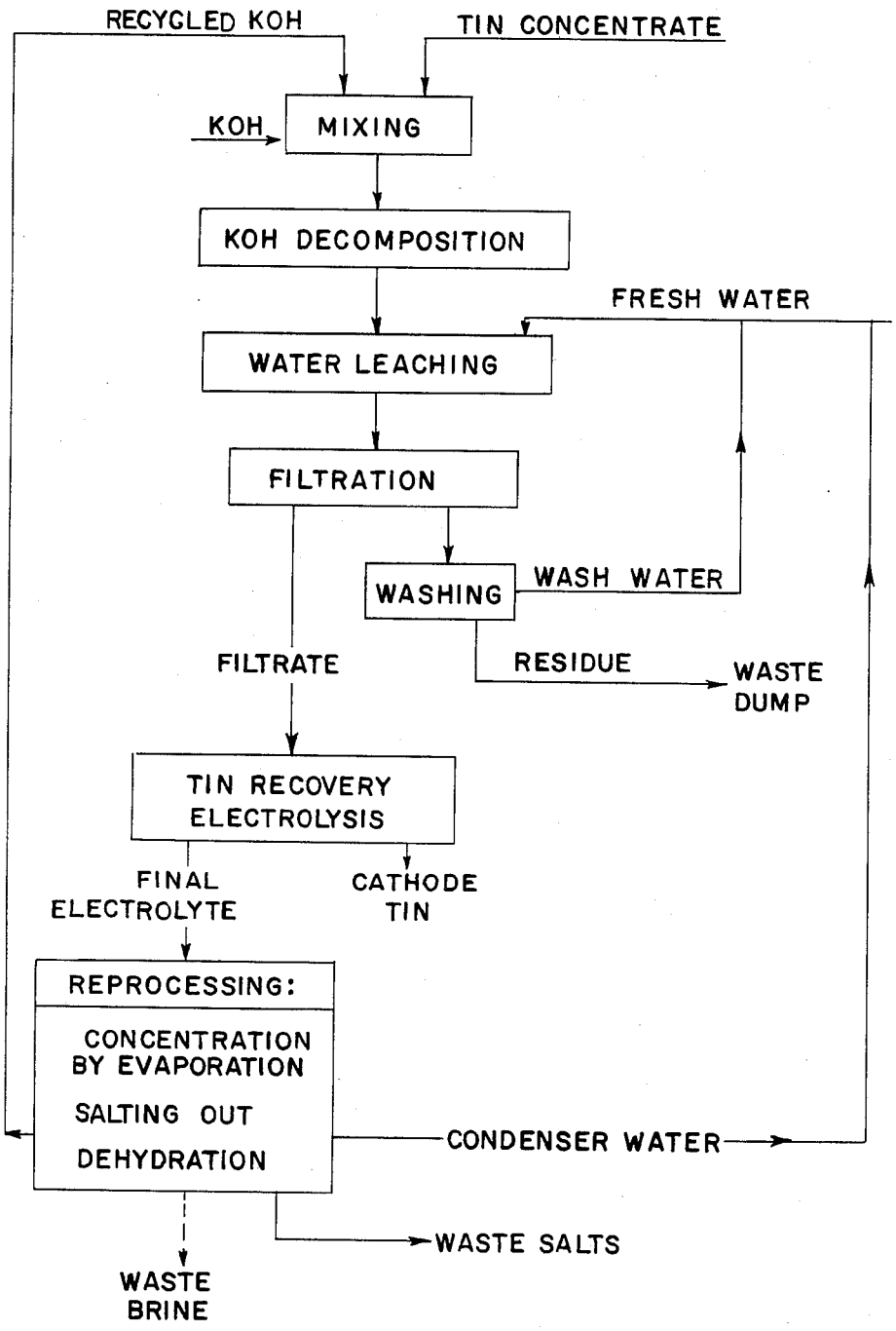
RECYCLED KOH
TIN CONCENTRATE
KOH
MIXING
KOH DECOMPOSITION
FRESH WATER
WATER LEACHING
FILTRATION
WASHING
WASH WATER
FILTRATE
RESIDUE
WASTE DUMP
TIN RECOVERY ELECTROLYSIS
FINAL ELECTROLYTE
CATHODE TIN
REPROCESSING:
CONCENTRATION BY EVAPORATION
SALTING OUT
DEHYDRATION
CONDENSER WATER
WASTE SALTS
WASTE BRINE

PROCESS FOR THE RECOVERY OF TIN

This application is a continuation of application Ser. No. 730,777 filed May 3, 1985, now abandoned.

BACKGROUND OF THE INVENTION

The invention relates to a process for recovering tin from starting materials containing relatively low concentrations of tin.

Supply of tin is based worldwide upon rich tin concentrates because, to be economically desirable, occurrences of tin are based upon rich concentrates of workable ores. The efficiency of the traditional pyrometallurgical two-stage recovery process depends strongly on the tin concentration in the first concentrate runnings. Even where there are favourable cost relationships, the boundary-line of efficient processing must be seen as 40 to 50% Sn and also 6% Fe in the concentrate.

It is true that fuming processes have been developed and put to industrial use with the volatilization of SnS (S being a carrier in the starting material or subsequently added) or SnO or SnOS, for the enrichment of starting materials containing little to relatively low concentrations of tin. These fuming processes modify these tin starting materials up to a more concentrated tin material for subsequent further processing on traditional pyrometallurgical lines into metallic tin, but such fuming processes operate at high temperature (1000° to 1400° C.) with huge energy consumption and represent only an enrichment process. Chlorination processes, for reasons connected with equipment and corrosion engineering, have not been able to gain acceptance.

The advances made in preparation technology make it possible, in particular, efficiently to enrich, from oxide and oxide/sulphide starting materials or ores, concentrates having up to a 10 to 25% Sn content. Such starting materials can be added only to a limited extent to very rich Sn concentrates (much greater than 60%) for the traditional two-stage tin recovery, where an iron content of less than or equal to 6% also has has to be observed. A direct tin-recovery process from starting materials with about 10 to 30% Sn content does not yet exist and has not not been put to industrial use.

Starting materials of such low Sn concentration cannot be efficiently processed into metallic tin with presently conventional pyrometallurgical two-stage recovery process using:

1. partial metal reduction for tin recovery with slag formation having 8 to greater than 25% Sn,
2. slag reduction with hard slag production containing 40 to 80 % Sn and 20 to 50% Fe and finishing slags containing less than 1% Sn,
3. hard slag re-introduced into the first processing stage.

The task of the present invention is to provide a simple process with which it is possible to convert the first $SnO_2$/SnS runnings from a poor concentrate by a decomposition through melting into water-soluble compounds from which metallic tin can recovered electrolytically.

This problem is solved by having the decomposition by melting effected with potassium hydroxide under inert gas or in air.

BRIEF DESCRIPTION OF THE DRAWING

The Figure provides a schematic flow chart of tin recovery from tin oxide or tin oxide/tin sulphide starting materials containing low concentrations of or little tin.

DESCRIPTION OF THE PREFERRED EMBODIMENTS

The decomposition substance is leached at one or more stages at 283° K. or higher temperatures in water or aqueous alkali solution, and the lye that is formed and filtered out after decomposition and leaching is subjected to a high temperature and a cathodic current density between 50 and 500 $A/m^2$ to conduct electrolysis for recovery of the metallic tin.

In pursuance of the idea of the invention, an especially progessive aspect is the fact that the final electrolyte of the tin-recovering electrolysis can be recovered by evaporation and concentration, salting out foreign substances and dehydrating as decomposition agent, and then re-employed to decompose the starting material by melting.

Not only low-grade ores may be regarded as starting materials in the sense of the invention, but also tin containing by-products or residues from tin recovery.

A low-grade tin concentrate in the sense of the invention comprises, for example: 10 to 40% Sn, 5 to 40% Fe, 0 to 10% S, 5 to 20% $SiO_2$, 5 to 20% $Al_2O_3$ and 0 to 10% $TiO_2$. Such a mixture is mixed with a sufficient quantity of KOH to convert the Sn content involved in a decomposition by melting into a soluble form, so that potassium stannates are formed. Under inert gas or in air, a decomposition product results, containing tin in a form soluble in an aqueous solution.

In a second processing step, the decomposition substance, in one stage or in several consecutive leaching steps, is leached at greater than 283° K., especially in countercurrent with water, preferably at high temperatures. In this leaching process the tin is quantitatively almost dissolved. The filter residue is then washed, and the washing water is passed back into the leaching process. This is possible because the leaching is also carried out with water.

In a third processing step, through single or multistage electrolysis, tin is recovered from the filtered lye solution directly at the cathode of steel, stainless steel or nickel electrodes plated with tin.

In a fourth processing step, the final electrolyte, stripped of tin or having its tin much reduced, is concentrated by evaporation so that salt out takes place, undesired impurities are removed, and finally it is dehydrated. The recovered potassium hydroxide passes back to the first processing step. The process in accordance with the invention is represented in the flow chart of the FIGURE and will now be illustrated in greater detail by two examples. In the FIGURE the tin concentrate represents possible additions, water leaching can be in one or more stages, fresh water can be condenser water, tin recovery electrolysis can be in one or more stages, and cathode tin can be formed by melting off or stripping and melting down (mach refining) casting.

EXAMPLE 1

100 parts of the low-grade tin concentrate indicated above were mixed with a quantity of potassium hydroxide sufficient to convert the Sn into water-soluble form (e.g. $SnO_2$: KOH=1:13) and then decomposed in the temperature range 713°–753° K. By means of subsequent hot water leaching at 343° K., almost 100% of the early Sn runnings were dissolved.

With an initial electrolyte concentration of 30 g Sn/l and temperatures of 343°–348° K., cathode tin at a current density of 100 A/m$^2$ (greater than 99.5% Sn; 0.3% Fe; less than 100 g/t Al and traces of As, Pb, Sb, Zn) was produced up to Sn contents in the final electrolytes of approximately 0.5 g Sn/l.

Over 90% of the potassium hydroxide was recovered for re-use for decomposition purposes by concentration through evaporation, salting out from foreign substances and dehydrating. The Sn yield is greater than 90% of the content of the first concentrate runnings.

EXAMPLE 2

100 parts of the low-grade tin concentrate indicated above were mixed with a quantity of potassium hydroxide sufficient to convert the Sn into water-soluble form such as $SnO_2$: KOH=1:15 and then decomposed in the temperature range 703°–733° K. Almost 100% of the early Sn runnings were dissolved by a subsequent leaching with hot water.

With an initial electrolyte concentration of 70 g Snl at high temperature and current density of 400 A/m$^2$, the cathode tin produced was of greater than 99.5% pure Sn.

After concentration by evaporation, salting out from foreign substances, and de-hydrating, the final electrolyte permitted recylcing of greater than 90% of the potassium hydroxide into the decomposition stage. The total yield of Sn is greater than 90% of the content of the first concentrate runnings.

What is claimed is:

1. A process for the recovery of tin from starting materials that contain tin oxide or tin oxide and tin sulfide, in which the tin is separated out electrolytically after leaching, wherein the process comprises:

treating a low-grade starting material having between about 10 and 40 percent tin that is present as tin oxide or tin oxide and tin sulfide by subjecting said low-grade starting material to a decomposition process, said decomposition process including mixing said low-grade starting material with a quantity of potassium hydroxide sufficient to convert tin into a water-soluble component in order to form a reaction mixture and melting said mixture of potassium hydroxide and low-grade starting material within a gaseous decomposition atmosphere that is selected from the group consisting of an inert gas and air in order to decompose said low-grade starting material and form a tin-containing, water-soluble decomposition product;

subsequently leaching such decomposition product with water for recovering tin from said low-grade starting material tin as a filtrate and subsequently electrolyzing said filtrate by using an electrolyte wherein tin is recovered at a cathode and a spent electrolyte containing potassium hydroxide is formed.

2. The tin recovery process according to claim 1, wherein said decomposition product leaching is carried out at a temperature of at least 283° K. within an aqueous environment.

3. The tin recovery process according to claim 2, wherein the aqueous environment is water.

4. The tin recovery process according to claim 2, wherein the aqueous environment is an alkaline aqueous solution.

5. The tin recovery process according to claim 1, wherein a lye is formed after said decomposition process and leaching step, and said lye is filtered and electrolysed at a cathodic current density between about 50 and about 500 A/m$^2$.

6. The tin recovery process according to claim 2, wherein a lye is formed after said decomposition process and leaching step, and said lye is filtered and electrolysed at a cathodic current density between about 50 and about 500 A/$m_2$.

7. The tin recovery process according to claim 1, wherein said sufficient quantity of potassium hydroxide is defined as a weight ratio of $SnO_2$ to potassium hydroxide of 1 to at least about 13.

8. The tin recovery process according to claim 1, wherein said water soluble tin component is a potassium 9. The tin recovery process according to claim 1, wherein said water soluble tin component is a potassium stannate; the sufficient quantity of potassium hydroxide is defined as a weight ratio of $SnO_2$ to potassium hydroxide of 1 to at least about 13; and said melting step of the decomposition process forms molten potassium hydroxide within which said low grade starting material is decomposed into said tin-containing water-soluble decomposition product.

10. The process in accordance with claim 1 wherein potassium hyroxide is recovered from the spent electrolyte.

* * * * *

UNITED STATES PATENT AND TRADEMARK OFFICE

CERTIFICATE OF CORRECTION

PATENT NO. : 4,737,351

DATED : April 12, 1988

INVENTOR(S) : Krajewski et al.

It is certified that error appears in the above-identified patent and that said Letters Patent is hereby corrected as shown below: Title page:

Under References Cited, U.S. PATENT DOCUMENTS, line 10, "Iid" should read --Iio--.

Col. 1, line 44, after "has", delete "not".

Col. 4, line 35, after "potassium", insert --stannate--.

Signed and Sealed this

Twenty-eighth Day of February, 1989

*Attest:*

DONALD J. QUIGG

*Attesting Officer*

*Commissioner of Patents and Trademarks*